US006536757B2

(12) United States Patent
Chang

(10) Patent No.: US 6,536,757 B2
(45) Date of Patent: Mar. 25, 2003

(54) SHEET SEPARATOR IN A PRINTER

(75) Inventor: Won-Kil Chang, Suwon-shi (KR)

(73) Assignee: Samsung Electronics Co., Ltd., Suwon (KR)

( * ) Notice: Subject to any disclaimer, the term of this patent is extended or adjusted under 35 U.S.C. 154(b) by 15 days.

(21) Appl. No.: 09/812,686

(22) Filed: Mar. 21, 2001

(65) Prior Publication Data

US 2001/0040335 A1 Nov. 15, 2001

(30) Foreign Application Priority Data

May 12, 2000 (KR) ..... 2000-25323

(51) Int. Cl.[7] ..... B65H 3/42; B65H 3/30; B65H 3/52; B65H 3/34

(52) U.S. Cl. ..... 271/16; 271/19; 271/21; 271/121; 271/167

(58) Field of Search ..... 271/16, 19, 21, 271/121, 167

(56) References Cited

U.S. PATENT DOCUMENTS 4,635,922 A * 1/1987 Roetter et al. ..... 221/259
5,660,384 A * 8/1997 Kovach et al. ..... 271/145
5,895,040 A * 4/1999 Oleksa et al. ..... 271/124
5,971,390 A * 10/1999 Caspar et al. ..... 271/121
2002/0060396 A1 * 5/2002 Tanaka ..... 271/121
2002/0060397 A1 * 5/2002 Endo ..... 271/121

* cited by examiner

*Primary Examiner*—Donald P. Walsh
*Assistant Examiner*—Kenneth W Bower
(74) *Attorney, Agent, or Firm*—Robert E. Bushnell, Esq.

(57) ABSTRACT

A device for preventing a slip-down of sheets of paper contained in an automatic sheet feeding section obliquely mounted in an ink jet printer is provided. The device includes a buckler body having a plate in contact with a bottom of sheets loaded in the automatic sheet feeding section, a guide projection formed at one side of an upper surface of the buckler body for jumping up a sheet located at the top of the loaded sheets, and at least one or more jack buckler having a plurality of teeth each having a slide side and a threshold side, the slide side guiding the sheet located at the top loaded sheets while the threshold side holds remaining sheets beneath the sheet guided by the slide side.

20 Claims, 5 Drawing Sheets

300

SHEET SEPARATOR IN A PRINTER

CLAIM OF PRIORITY

This application makes reference to, incorporates the same herein, and claims all benefits accruing under 35 U.S.C. §119 from my application PREVENTING DEVICE FROM SLIP-DOWN OF PAPER IN INK JET PRINTER filed with the Korean Industrial Property Office on May 12, 2000 and there duly assigned Serial No. 2000-25323.

BACKGROUND OF THE INVENTION

1. Field of the Invention

The present invention relates to a sheet separator mounted on an automatic sheet feeding device of a printer, and more particularly, to a sheet separator having an improved buckler mounted on the automatic sheet feeding device in the printer.

2. Description of the Related Art

An automatic sheet feeding device including a sheet separator has been used in an ink jet printer. The automatic sheet feeding device is obliquely installed on a side of a printing device in the ink jet printer that horizontally rests on a table. Sheets of paper are loaded in the automatic sheet feeding device and are slanted with respect to the side of the printing device. The sheet separator is mounted on a lower portion of the automatic sheet feeding device and disposed to contact the lower ends of the sheets loaded in the automatic sheet feeding device. The sheets are separated by the sheet separator and supplied one by one to the side of the printing device of the printer by a pick-up roller disposed adjacent to the automatic sheet feeding device. The sheet separator, however, can neither separate and supply the sheets one by one from the automatic sheet feeding device to the printing device nor support remaining sheets of paper loaded within the automatic sheet feeding device while supplying of one of the sheets to the printing device.

In efforts to improve the sheet separator, U.S. Pat. No. 5,895,040 entitled Sheet Separator to Oleksa et al. and U.S. Pat. No. 5,938,190 entitled Specialty Media Feed Guide Snd Sheet Feeding Apparatus Using Same to Campbell et al. disclose two different friction materials and a plurality of friction pads attached to the automatic sheet feeding device. Sheet separating and guiding mechanisms disclosed in these references, however, are not sufficient to separate the sheets one by one, support the sheets stacked in the automatic sheet feeding device diagonally mounted on the printing device, and guide the sheets one by one from the automatic sheet feeding device to the printing device in a horizontal direction.

The automatic sheet feeding device having the conventional sheet separator fails to separate a single sheet from the sheets stacked in a tray of the automatic sheet feeding device. Moreover, a plurality of sheets will slip down to the sheet separator due to vibration generated in the course of picking-up a sheet from the sheet stacked in the tray, and the plurality of the sheets are picked up simultaneously and fed to the printing device when a particular type of sheets, such as an over head projection medium or coated papers, are used, or when the printer is used in high temperature and high humidity condition.

SUMMARY OF THE INVENTION

It is an object of the present invention to provide an improved sheet separator mounted on an automatic sheet feeding device diagonally installed in an ink jet printer.

It is another object to provide a sheet separator able to effectively support sheets of paper within an automatic sheet feeding device diagonally installed in an ink jet printer.

It is yet another object to provide a sheet separator able separate sheets one by one from an automatic sheet feeding device diagonally installed in an ink jet printer.

It is still yet another object to provide a sheet separator able to hold remaining sheets stacked within an automatic sheet feeding device diagonally installed in an ink jet printer.

It is also an object to provide a sheet separator able to prevent a slip down of sheets stacked within an automatic sheet feeding device diagonally installed in an ink jet printer during picking up a sheet located on a top of the sheet.

It is further object to provide a sheet separator able to prevent a plurality of sheets from being picked up from an automatic sheet feeding device diagonally installed in an ink jet printer simultaneously.

These and other objects of the present invention may be achieved by providing an improved sheet separator for preventing a slip-down of sheets stacked in an automatic sheet feeding device diagonally installed in a main body of a printing device of an ink jet printer. The sheet separator includes a friction dam disposed to contact lower edges of sheets loaded in the sheet feeding device, a buckler body disposed on the friction dam and between the friction dam and the lower edges of the sheets, a guide projection formed on an upper side of the buckler body for jumping up a top sheet located on a top of the sheets from the automatic sheet feeding device toward the printing device of the ink jet printer, and at least one or more jack bucklers having a plurality of inclined projections having a slide side and a threshold side, the slide side allowing a lower edge of the sheet located on the top of the sheets to be jumped toward the main body of the printing device while the threshold side prevents lower edges of the remaining sheets from moving toward the slide side.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, and wherein.

DETAILED DESCRIPTION OF THE PREFERRED EMBODIMENT

Figure 1:
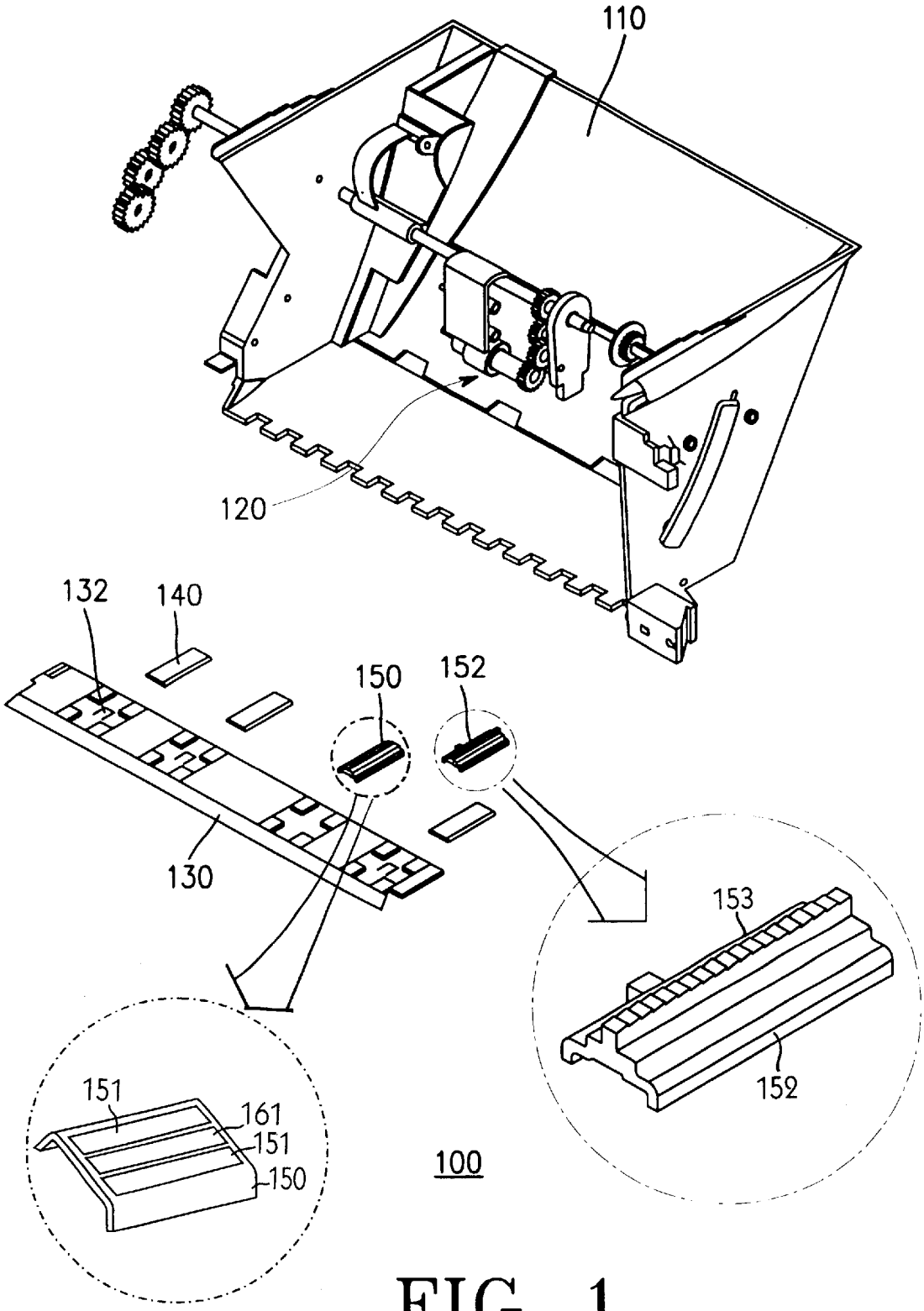
FIG. 1 is a perspective view of a sheet separating feeder of an ink jet printer constructed by the principle of the present invention.

Referring now to the drawings, FIG. 1 shows a perspective view of a sheet separating feeder diagonally mounted on a side of a printing device in an ink jet printer which is not shown in FIG. 1. An automatic sheet feeding section 100 includes a frame 110 slantingly installed on the side of the ink jet printer. Sheets of paper are loaded within frame 110. A lower edge of a sheet is separated from the sheets loaded in frame 110 and fed toward the printing device through an opening formed on the side of the printing device. The sheets loaded in the automatic sheet feeding device are inclined with respect to a horizontal line of the printing device. The sheet is fed obliquely, downwardly, and horizontally to the printing device of the ink jet printer. A pick-up unit 120 is rotatably mounted on a rotary pivot connected to the frame 110 of the of automatic sheet feeding section 100 transfers the loaded sheets to the printing device in the ink jet printer. A friction dam 130 is located on a passageway of the sheets, and includes a plurality of dam grooves 132 and a paper guide 140 installed in one of dam groove 132 for guiding a picked-up sheet to the printing device in a horizontal direction. Automatic sheet feeding section 100 separates and supplies the sheets to the printing device one by one.

A buckler bracket 150 is installed in one of dam grooves 132 and includes friction surfaces 151 in an upper surface thereof, and a friction bracket 152 is mounted on the upper surface of buckler bracket 150 for separating each sheet from the sheets. Friction bracket 152 is made of a soft material, such as a rubber material, and may be attached to one of dam grooves 132 without being mounted on the upper surface of buckler bracket 150. If friction bracket 152 is disposed between one of dam grooves 132 and buckler bracket 150 placed on the one of dam grooves 132, then teeth 153 protrude through an elongated opening 160 formed on a longitudinal surface of a center portion of buckler bracket 150. A lower edge of the sheet contacts either one of teeth 153 and friction surface 151 formed on both sides of the elongated opening 160. Each one of teeth 153 has a threshold side and a sliding side having an angle with the threshold side.

Figure 2:
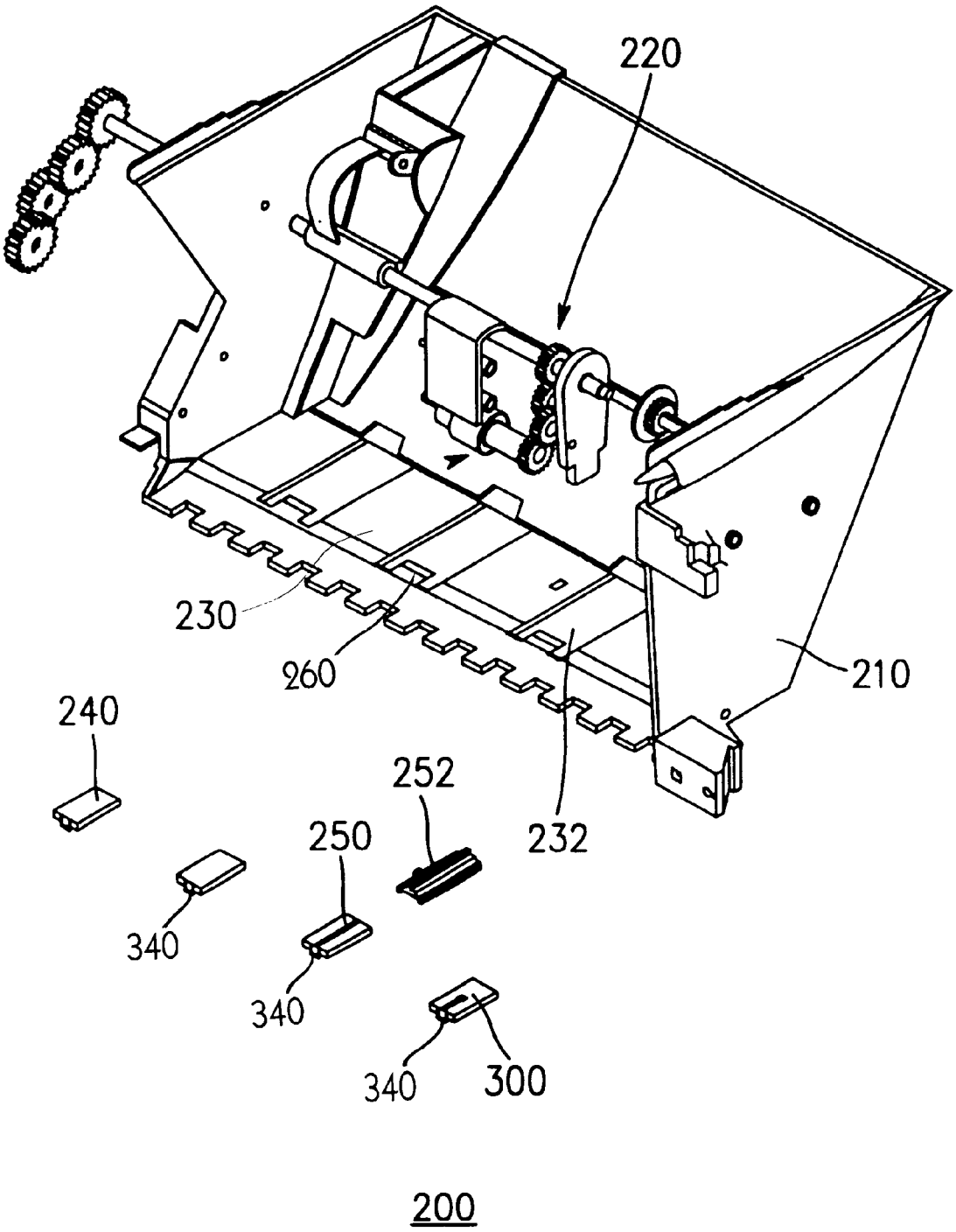
FIG. 2 is a perspective view of a second embodiment of a sheet separator mounted on an ink jet printer constructed by the present invention.
Figure 3:
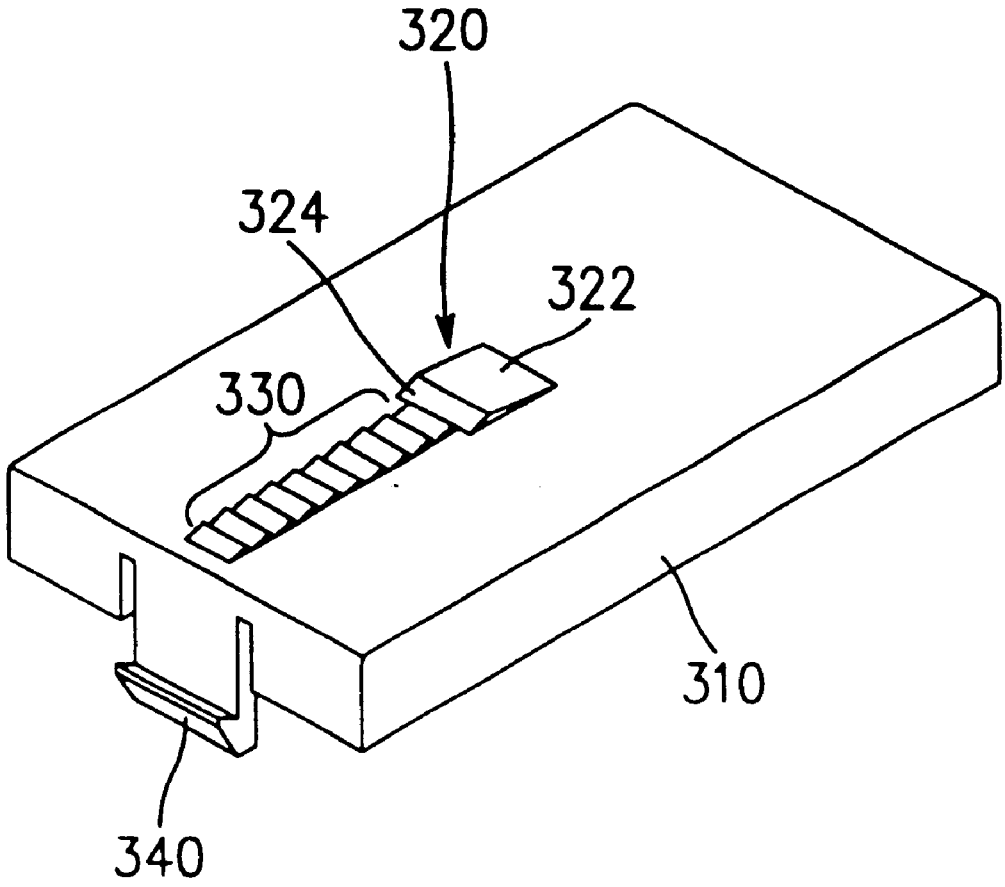
FIG. 3 is a perspective view of a jack buckler of FIG. 2.
Figure 4:
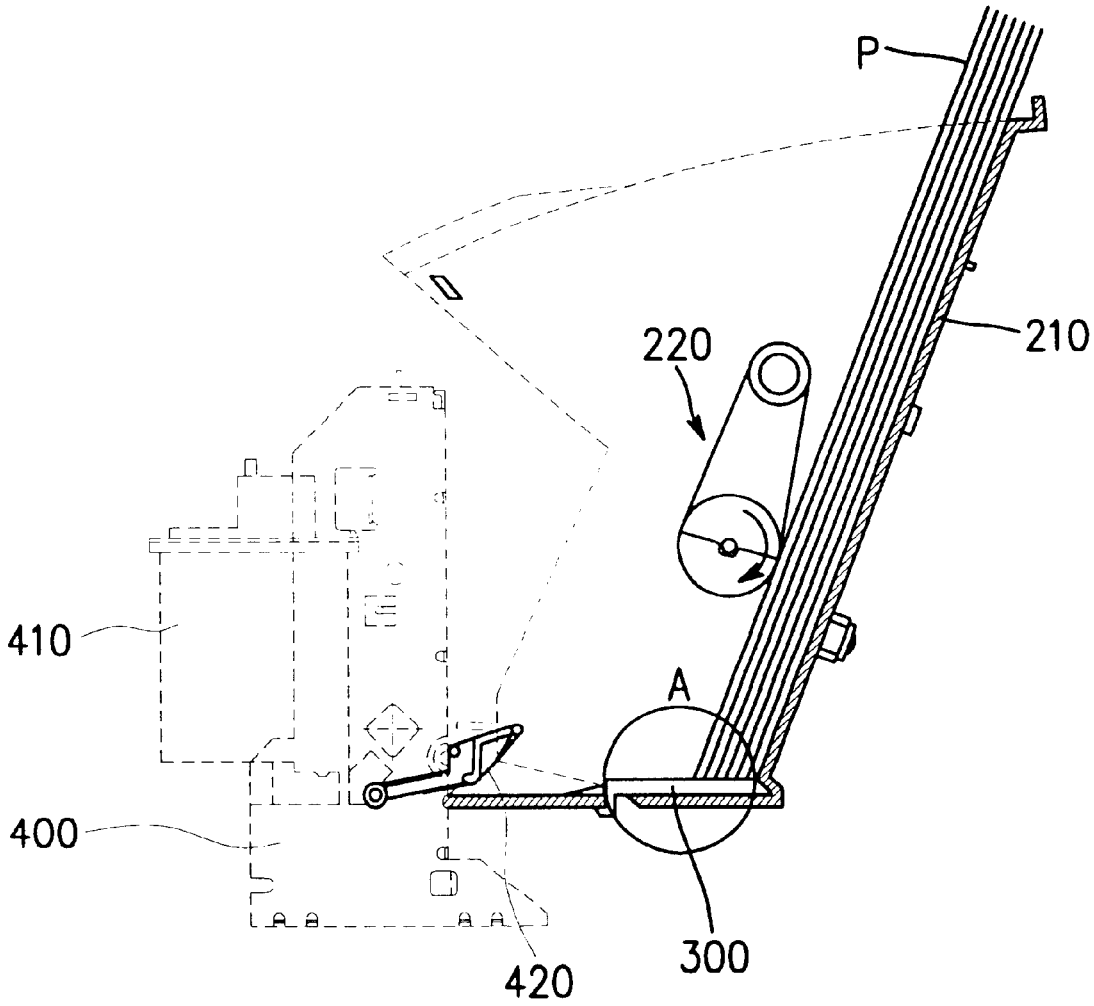
FIG. 4 is a side view illustrating a jack buckler coupled on a automatic sheet feeding device slantingly mounted on a main body of a printing device in an ink jet printer constructed by the principle of the present invention.

Referring to FIGS. 2 to 4, an automatic sheet feeding section 200 in an ink jet printer includes a frame 210 diagonally installed in a side of a printing device in an ink jet printer for accommodating loading of sheets P, a pick-up unit 220 installed on a rotary pivot of frame 210, a friction dam 230 disposed to contact lower edges of sheets and including a plurality of dam grooves 232 and a sheet guide 240 installed in one of dam grooves 232 for guiding a picked-up sheet P to be fed to the printing device in a horizontal direction. The picked up sheet is picked up obliquely and downwardly, passes over friction dam 230 horizontally, and is fed toward the printing device horizontally. The printing device includes an ink cartridge 410, a sheet feeder 400, and a sheet controller 420. A sheet separated from frame 210 passes over jack buckler 300 and is fed horizontally between ink cartridge 410 and sheet feeder 400 while sheet controller 420 adjusts the sheet to be located on a position for printing an image on the sheet by ink cartridge 410.

Automatic sheet feeding section 200 separating a sheet from a stack of sheets includes a buckler bracket 250, as a sheet separator, installed in one of dam grooves 232 with a friction bracket 252, as a sheet separator, at a top thereof. Jack buckler 300, as a sheet separator, may be installed in one of dam grooves 232 without a friction bracket 252 while friction bracket 252 is installed in the other one of dam grooves 232. Jack buckler 300 is installed in one of dam grooves 232 of friction dam 230 together with sheet guide 240 and buckler bracket 250 to prevent a slip-down of sheets P as well as to separate a sheet from a stack of sheets P. Friction buckler 252 may be referred to friction buckler 152 of FIG. 1 while buckler bracket 250 may be referred to buckler bracket 150 of FIG. 1. A hook 340 is formed on each one of sheet guide 240, buckler bracket 250, and jack buckler 300 so that sheet guide 240, buckler bracket 250, and jack buckler 300 are detachably attached to opening 260 formed on dam grooves 232 of friction dam 230 and are easily replaced with a new one after used for a predetermined period of time.

Jack buckler 300 molded by a injection molding of a plastic material includes a buckler body 310, a guide projection 320, a plurality of teeth 330, and hook 340. The injection molding of the plastic material provides jack buckler 300 with superior characteristics of a uniform shape and an accurate size as well as a high abrasion resistance. Buckler body 310 of jack buckler 300 has an upper surface of a flat rectangular shape. Each corner of an upper portion of buckler body 310 is rounded so as not to prevent the lower end of sheets P form moving toward the printing device from frame 210.

Guide projection 320 is an initial portion L of buckler body 310 where a sheet located on a top of the stack of sheets is allowed to jump up and fed over friction dam 230 toward the printing body. Guide projection 320 has upwardly and downwardly inclined sides 322, 324. As the sheet located on the top of the stack of sheets is jumped up by guide projection 320 due to a friction with a pick-up roller, the sheet may be directly picked up without contacting downwardly inclined side 324 of guide projection 320.

Figure 5:
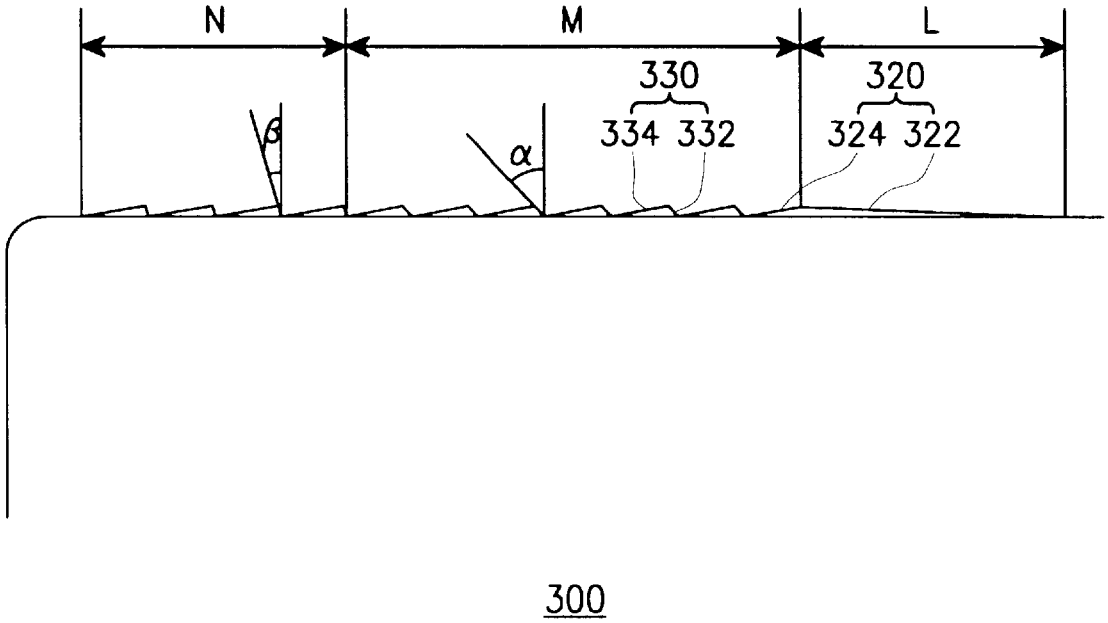
FIG. 5 is a partially enlarged sectional view of jack buckler indicated by A in FIG. 4.

Teeth 330 having a threshold side 332 and a sliding side 334 prevent a plurality of the sheets from being picked up simultaneously due to a slip-down of the plurality of the sheets from guide projection 320. A plurality of teeth 330 are formed on a top surface of buckler body 310 adjacent to guide projection 320. Two different groups of teeth 330 are formed on the top surface of buckler body 310 in a series adjacent to guide projection 320. A first group of teeth 330 is located in a first portion M of the top surface of buckler body 310 while a second group of teeth 330 is located in a second portion N of the top surface of buckler body 310. As shown in FIG. 5, threshold side 332 of first portion M has an angle $\alpha$ with a first plane perpendicular to a second plane of the surface of the buckler body 310 while threshold side 332 of second portion N has an angle $\beta$ with the first plane perpendicular to the second plane of the surface of the buckler body 310. Angle $\alpha$ of threshold side 332 of teeth 330 formed in first portion M is greater than angle $\beta$ of threshold side 332 of teeth 330 formed in second interval N. When a sheet is jumped up while passing through guide projection 320, and when remaining sheets slide along guide projection 320 and are located in first portion M and second portion N of teeth 330 due to vibration, respective ends of the sheets are remained between thresholds side 332 and sliding side 334 of teeth 330. The Sheets remained between thresholds side 332 and sliding side 334 of teeth 330 is picked up one by one and separated by threshold side 332 of teeth 330.

Hook 340 is extended downwardly from a side of buckler body 310 and has an outwardly-cut shape to be inserted into opening 260 formed on dam grooves 232 and detachably attached to dam grooves 232 so that buckler body 310 may not be separated when installed in dam groove 232 of friction dam 230.

As described above, the sheet separating device constructed by the principle of the present invention prevents a slip-down of sheets in an ink jet printer and enhances reliability in an pickup operation of sheets one by one in the ink jet printer. The plurality of sheets are prevented to be picked up simultaneously.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A sheet separating device in a printer having a printing device, comprising:

a frame diagonally mounted on a side of said printing device, accommodating loading of sheets to be fed to said printing device through an opening formed on said side of said printing device;

a dam disposed on a lower end of said frame to contact a lower edge of the sheets loaded in said frame, having a groove;

a buckler body detachably attached to said groove, having a first plane in contact with said lower edge of the sheets;

a first tooth formed on an upper surface of said buckler body, having a first slide side and a first threshold side having a first angle with respect to a second plane perpendicular to said first plane of said buckler body; and a second tooth formed on said upper surface of said buckler body, having a second slide side and a second threshold side having a second angle with respect to said second plane perpendicular to said first plane of said buckler body, said second angle being different from said first angle.

2. The sheet separating device of claim 1, wherein said second angle being greater than said first angle.

3. The sheet separating device of claim 1, further comprising a guide protrusion formed on said upper surface of said buckler body, having a third slide side and a third threshold side having a third angle with respect to said second plane perpendicular to said first plane of said buckler body, said third angle being different from said first angle.

4. The sheet separating device of claim 3, wherein said third angle being greater than said first angle.

5. The sheet separating device of claim 3, wherein said third angle being greater than said second angle.

6. The sheet separating device of claim 3, with said first tooth, said second tooth, and said guide protrusion arranged between said frame and said printing device in series.

7. The sheet separating device of claim 3, with said second tooth disposed between said first tooth and said guide protrusion.

8. The sheet separating device of claim 3, with said guide protrusion, said first tooth, and said second tooth arranged in a series in a direction for feeding the sheets from said frame toward said printing device.

9. The sheet separating device of claim 1, with said first tooth and said second tooth disposed between said frame and said printing device, said first tooth disposed adjacent to said frame while said second tooth is disposed adjacent to said printing device.

10. The sheet separating device of claim 1, said first tooth and said second tooth arranged in a series in a direction for feeding the sheets from said frame toward said printing device.

11. The sheet separating device of claim 1, with said first slide side of said first tooth coupled to said second threshold side of said second tooth.

12. The sheet separating device of claim 1, further comprising a plurality of second teeth each having said second slide side and said second threshold side, said plurality of said second teeth arranged in series in a direction for feeding the sheets from said frame toward said printing device.

13. The sheet separating device of claim 12, with said second slide side of one of said teeth coupled to said second threshold side of the other one of said second teeth.

14. The sheet separating device of claim 13, wherein said lower edge of one of the sheets is displaced between said second slide side said second threshold side.

15. The sheet separating device of claim 14, wherein said lower edge of the sheets contacts said first plane of said buckler body.

16. A sheet separating device in a printer having a printing device, comprising:

a frame mounted on said printing device, accommodating loading of sheets;

a dam disposed on a lower end of said frame to contact a lower edge of the sheets loaded in said frame, having a groove;

a buckler body detachably attached to said groove, having a first plane in contact with said edge of the sheets; and a first group and a second group of projections formed on said first plane of said buckler body in series, each projection having a slide side and a threshold side, said threshold side of said first group of projections having a first angle with respect to a second plane perpendicular to said first plane of said buckler body while said threshold side of said second group of projections having a second angle and with respect to a second plane perpendicular to said first plane of said buckler body, said first angle being different from said second angle.

17. The sheet separating device of claim 16, wherein said first group of projections is disposed adjacent to said frame while a second group of projections is disposed adjacent to said printing device.

18. The sheet separating device of claim 17, wherein said first angle being greater than said second angle.

19. The sheet separating device of claim 17, further comprising a guide projection formed between said first group of projections and said frame, having a second slide side and a second threshold side having a third angle with respect to a second plane perpendicular to said first plane of said buckler body, said third angle being different from one of said first angle and said second angle.

20. The sheet separating device of claim 17, wherein said third angle being greater than said first angle.

* * * * *